US005634582A

United States Patent [19]

Morrison, Jr. et al.

[11] Patent Number: 5,634,582

[45] Date of Patent: Jun. 3, 1997

[54] FASTENER LENGTH ADJUSTABLE CANISTER-TYPE MAGAZINE FOR A FASTENER DRIVING TOOL

[75] Inventors: William H. Morrison, Jr., Plainfield, Ind.; Dennis E. Stivers, Sardinia, Ohio

[73] Assignee: Senco Products, Inc., Cincinnati, Ohio

[21] Appl. No.: 461,139

[22] Filed: Jun. 5, 1995

[51] Int. Cl.[6] ..... B25C 1/04

[52] U.S. Cl. ..... 227/109; 227/128; 227/136; 206/338

[58] Field of Search ..... 227/109, 120, 227/135, 136, 137, 127, 128; 206/338

[56] References Cited

U.S. PATENT DOCUMENTS

| | | | |
|---|---|---|---|
| 3,330,462 | 7/1967 | Colechia et al. | 227/136 |
| 3,524,576 | 8/1970 | Bader | 227/136 |
| 3,568,908 | 3/1971 | Bader | 227/109 |
| 3,688,966 | 9/1972 | Perkins et al. | 227/136 |
| 3,945,551 | 3/1976 | Sato et al. | 227/136 |
| 4,433,782 | 2/1984 | Figge et al. | 227/109 |
| 4,600,135 | 7/1986 | Mukoyama | 227/120 |
| 5,285,944 | 2/1994 | Green et al. | 227/19 |

FOREIGN PATENT DOCUMENTS

| | | |
|---|---|---|
| 0644020 | 3/1995 | European Pat. Off. . |
| 3403312 | 1/1984 | Germany . |
| 1239625 | 7/1971 | United Kingdom . |

*Primary Examiner*—Scott A. Smith
*Attorney, Agent, or Firm*—Jerrold J. Litzinger

[57] ABSTRACT

A canister-type magazine for a fastener driving tool using a coil of tandemly arranged fasteners. The magazine comprises a substantially cylindrical body having a top, a bottom and side walls. The magazine is openable, providing access to the interior thereof. A cylindrical magazine post extends upwardly from the center of the magazine bottom. A pair of latch members are located in diametric openings in the magazine post near the upper end thereof. The latch members are shiftable between a first position wherein they extend beyond the peripheral surface of the magazine post and a second position wherein they are within the confines of the peripheral surface of the magazine post. The latch members are biased to their first position. A fastener coil supporting platform is provided having a hollow center post with an interior diameter sized to slidingly receive the magazine post. The platform post has at least two pairs of diametric openings in its cylindrical side wall. Each pair of openings in the support post are adapted to be located coaxially with the pair of openings of the magazine post and to receive the latch members in their first extend positions whereby the platform is lockable in at least two positions along the magazine post to accommodate coils of fasteners of at least two different lengths.

6 Claims, 3 Drawing Sheets

FASTENER LENGTH ADJUSTABLE CANISTER-TYPE MAGAZINE FOR A FASTENER DRIVING TOOL

TECHNICAL FIELD

The invention relates to an improved canister-type magazine for a fastener driving tool adapted to use a coil of fasteners, and more particularly to such a magazine which is more easily adjusted for fasteners of different lengths.

BACKGROUND ART

Prior art workers have devised a number of different magazines for fastener driving tools wherein the fasteners are arranged in tandem in strips which are coiled. This arrangement generally increases the number of fasteners which can be accommodated by the magazine, as compared to the capacity of a typical linear magazine. There are various types of fasteners which can be arranged in coiled strips. For example, headed and headless nails, blind rivets and the like fall into this category. Nails are generally the most common fastener found in coiled form. For this reason, and for purposes of an exemplary showing, the magazine of the present invention will be described in its application to a nail driving tool. It will be understood, however, that the nature of the fastener is not a limitation of the present invention.

The nails of a strip are arranged and held in a tandem row by any appropriate coilable means. These means may constitute tape means, paper means, wire means, plastic means or the like, all of which are well known in the Prior art workers have devised canister-type magazines provided with adjustable coil supporting platforms or support surfaces for the accommodation of fasteners of various lengths. The adjustment of the coil supporting surface of the canister-type magazine frequently has required disassembly of the magazine, or considerable manipulation thereof prior to or as a part of the loading operation.

U.S. Pat. No. 4,585,154 teaches a canister-type magazine made up of three parts: a mounting part, a coil supporting part, and a cover part. The mounting part is affixed to the fastener driving tool and comprises approximately one-half of the magazine's cylindrical side. The fastener coil supporting part comprises a bottom and a significant portion of the magazine side wall. The two elements can be adjustably joined together and held together by an over center latch. The mounting part also supports a cover part or lid which is movable between a magazine closing position and a magazine opening position. From the standpoint of loading, the magazine is fixed with respect to the tool and loading is accomplished from beneath the tool handle. To adjust for fasteners of different lengths, the mounting part and the fastener coil supporting part must be disassembled and reassembled in appropriately adjusted condition.

U.S. Pat. No. 4,996,648 is also exemplary of prior art structures. Here, a canister-type magazine is provided which is made up of two parts hinged together. Each of the parts comprises approximately one-half of the magazine side, one-half of the magazine bottom and one-half of the magazine top. One of the parts is fixed to the tool and the other part is swingable between open and closed positions. The patent teaches several embodiments of platform or support surface for a coil of fasteners. In a first embodiment, the magazine halves are provided with internal corresponding grooves. A separate platform or supporting surface is engaged in corresponding grooves of both halves, the grooves having been selected with regard to the length of the fasteners of the coil. In a second embodiment, the platform constitutes a separate member pivotally mounted on a shaft which is parallel to the hinge pin of the hinge by which the two magazine halves are joined together. The platform or support surface is adjustable on its pivot pin to accommodate fasteners of various lengths. In the loading operation for the first embodiment, the movable half of the magazine is swung to an open position. The support surface is engaged in the appropriate groove of the fixed half of the magazine and the coil is slipped onto the support surface, whereupon the other half of the magazine is swung to its closed position. In the second embodiment where the support surface is, itself, pivotally mounted, the movable magazine half is swung to its fully open position and the support surface is swung out from under the top portion of the fixed magazine half for purposes of loading. When the coil is located on the support surface, the support surface is swung into the fixed magazine half whereupon the movable magazine half is pivoted to its closed position. In co-pending application Ser. No. 08/367,431, filed Dec. 30, 1994, in the names of John T. Burke, Daniel A. Oliver and John P. Crutcher, and entitled CANISTER-TYPE MAGAZINE FOR A FASTENER DRIVING TOOL a magazine for a coil of fasteners is taught. The magazine comprises a fixed part and a movable part. The fixed part is attached to the fastener driving tool and the movable part is hinged to the fixed part, is swingable out from under the tool handle, and contains the fastener coil support surface. The fastener coil support surface is adjustable to accommodate various lengths of fasteners by adjustment of the swingable canister portion with respect to the fixed canister portion, in association with the hinge structure that joins them together. The co-pending application teaches a second embodiment wherein the canister has a bottom with an upstanding central post formed thereon. The central post is adapted to be slidably received in a hollow central post of a support platform. The support platform is captively mounted on the magazine center post. The magazine center post has a series of diametrically located pairs of vertical slots, the pairs of slots being of different lengths. The inside surface of the hollow post of the fastener support platform has a pair of diametrically opposed lugs which are receivable in any one of the magazine post pairs of slots, thus maintaining the fastener support surface in any one of a series of levels with respect to the magazine center post to accommodate fastener coils of different fastener lengths.

The present invention teaches a canister-type magazine of substantially cylindrical configuration and having a bottom. The magazine is openable so as to provide easy access to its bottom. The magazine bottom has an upstanding central post. A circular fastener support has a hollow central post slidably mountable on the magazine post. The fastener support may be held in at least two positions on the magazine post by a simple, manually manipulable spring biased latch means. Height adjustment of the fastener support within the canister is very easily and quickly accomplished manually and the entire canister-type magazine structure is easy and simple to manufacture and assemble with a minimum of parts. The teachings of the present invention are adaptable to any canister-type fastener magazine.

DISCLOSURE OF THE INVENTION

According to the invention them is provided a canister-type magazine for a fastener driving tool of the type using a coil of tandemly arranged fasteners. The magazine is generally cylindrical with a top and a bottom, and is openable in such a way that ready access to its interior is afforded.

The magazine has a cylindrical post extending upwardly from the center of the magazine bottom. The magazine post has, near its upper end, a pair of diametrically located openings, each containing a spring biased latch member.

The magazine is also provided with a fastener coil supporting platform having a hollow center post with an interior diameter sized to slidingly receive the magazine post. The post of the supporting platform has at least two pairs of diametric openings at different vertical positions along its length. The latch members may engage either pair of openings in the platform post with a snap fit to maintain the coil supporting platform and its post in a selected one of at least two levels with respect to the magazine post, whereby to accommodate coils of fasteners having at least two fastener lengths.

DETAILED DESCRIPTION OF THE INVENTION

Throughout the specification like parts have been given like index numerals.

Figure 1:
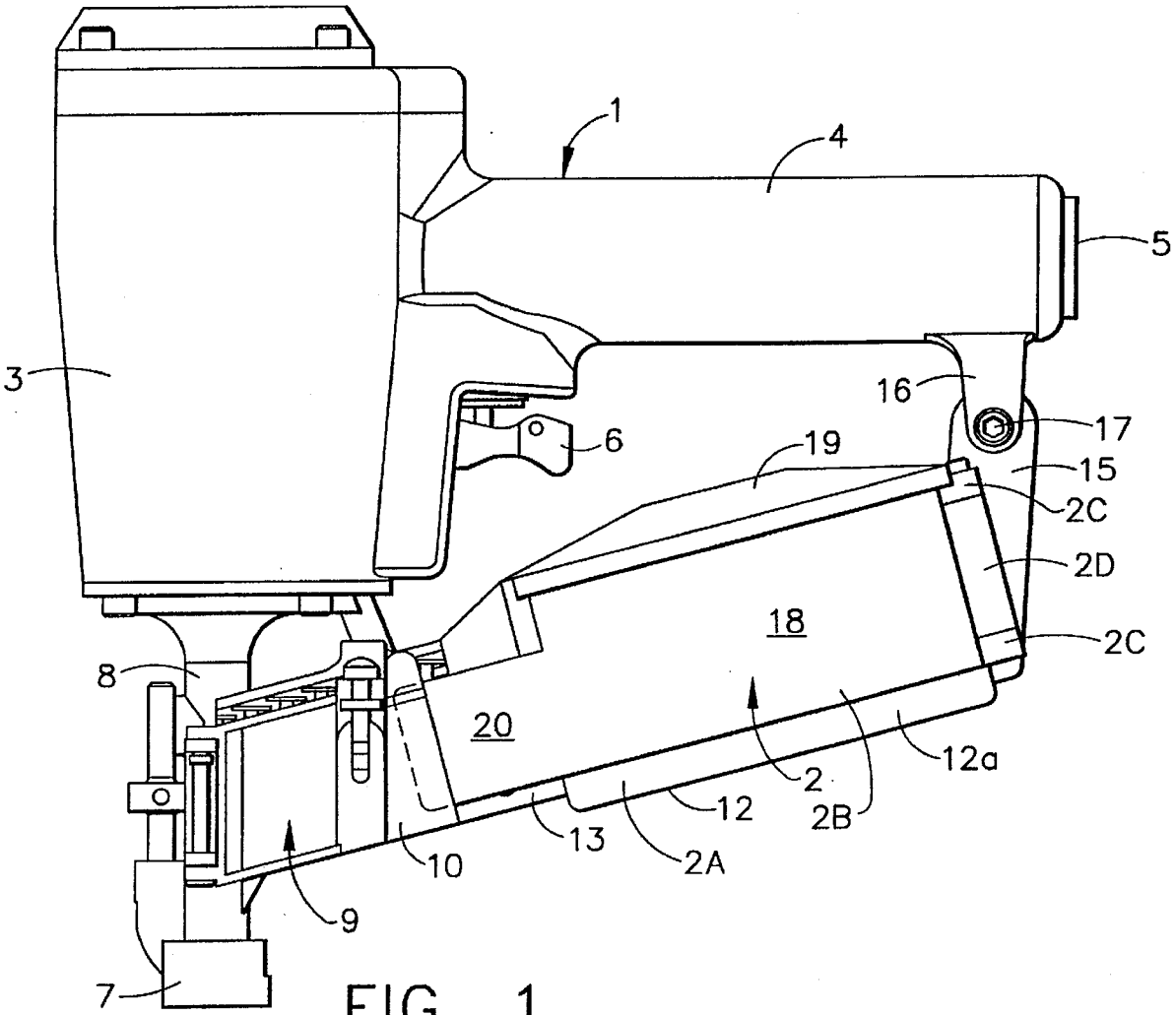
FIG. 1 is a side elevational view of an exemplary fastener driving tool provided with the canister-type magazine of the present invention.

Reference is first made to FIG. 1 which illustrates an exemplary fastener driving tool. Them are numerous types of fastener driving tools incorporating many types of mechanisms to actuate the fastener driver of the tool. For example, the driver may be actuated by a fly wheel assembly or a solenoid assembly in electrically actuated tools. There are also self-contained tools wherein the driver is actuated by internal combustion. The most common fastener driving tool is pneumatically actuated. For this reason, the tool 1 of FIG. 1 is illustrated as being a pneumatically actuated tool. The tool 1 is provided with a magazine of the present invention, generally indicated at 2. The tool 1 has a main body portion 3 and a handle portion 4.

As is well known in the art, the main body portion 3 of tool 1 contains a cylinder (not shown) having a piston/driver assembly (not shown) therein. A part of the main body portion 3 and the handle portion 4 constitute a reservoir for air under pressure. The air under pressure is introduced into the reservoir by a hose (not shown) connected to a source of compressed air (not shown). The hose is attached to the fining 5 of handle portion 4. The piston/driver assembly of the tool cylinder is actuated to drive a fastener by means of a normally closed main valve (not shown) at the top of the cylinder. The main valve may be opened (permitting high pressure air to actuate the piston/driver assembly to drive a fastener) by means of a remote valve (not shown) which is operated by the tool trigger 6. The tool trigger 6 is usually enabled by a safety trip 7, when the safety trip 7 is pressed against a workpiece.

Beneath the main body portion 3 of tool 1 there is a guide body 8. The guide body 9 contains a drive track(not shown) to accommodate a fastener to be driven into a workpiece and to accommodate the lower end of the piston/driver assembly.

The tool 1 is provided with a feed mechanism, generally indicated at 9. The feed mechanism 9 may take any appropriate form. A usual and well-known feed mechanism for this purpose comprises a pawl assembly actuable by a cylinder. After each cycle of the tool, the pawl assembly will engage the coiled strip and pull the strip incrementally from magazine 2, locating the forwardmost nail of the strip in the drive track of guide body 8. The feed mechanism 9 is provided with a releasably lockable closure gate 10 which maintains the forward portion of the fastener strip properly positioned for engagement by the pawl assembly.

Figure 3:
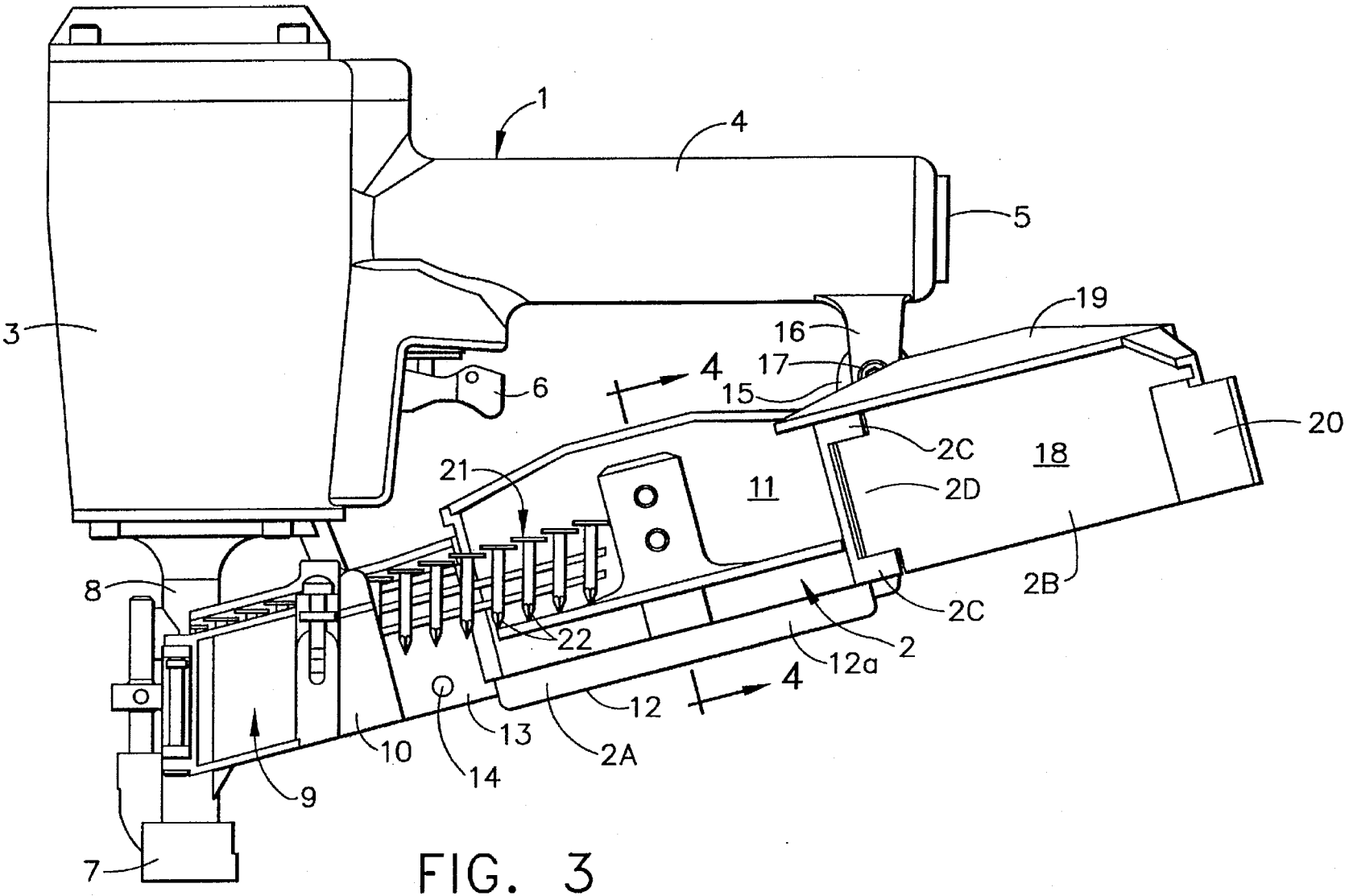
FIG. 3 is a side elevational view similar to FIG. 1 and illustrating the hinged magazine side and roof element in its open position.

Referring now to FIGS. 1 and 3, the magazine is made up of a fixed body part 2A and a movable body part 2B. The fixed body part 2A comprises a portion 11 of the cylindrical side wall of magazine 2, as well as the bottom 12 thereof. At its forward end the freed magazine body part 2A has an extension 13 attached by an appropriate fastener such as a machine screw or the like to the guide body/feed mechanism 8–9 of tool 1. The extension 13 can also serve as a guide for the strip of nails, as the strip of nails enters feed mechanism 9 from the magazine. At the rearward end of the fixed body part 2A of magazine 2 there is an upstanding lug 15 which is affixed to a downwardly depending extension 16 of handle portion 4 by a bolt 17 or other appropriate fastener.

The movable body part 2B of magazine 2 comprises the remainder of the side wall 18 of magazine 2 and the top 19 of the magazine. At its forward end, the movable body part 2B of magazine 2 has an extension 20. The extension 20 serves as a guide for the strip of nails as it enters feed mechanism 9.

At the rearward end of magazine 2, both the freed body part 2A and the movable part 2B are provided with cooperating hinge elements 2C and 2D. Thus, the movable body part 2B is swingable between a closed position illustrated in FIG. 1 and an open position illustrated in FIG. 3 providing easy access to the magazine interior for purposes of loading a coil of nails therein. It will be noted from FIG. 1 that, when the movable magazine part 2B is in its closed position, its forward extension 20 is overlapped by the feed mechanism gate 10 when in its closed and locked position. As a consequence, the feed mechanism gate 10 serves to lock the movable body part 2B of magazine 2 in its closed position.

Figure 2:
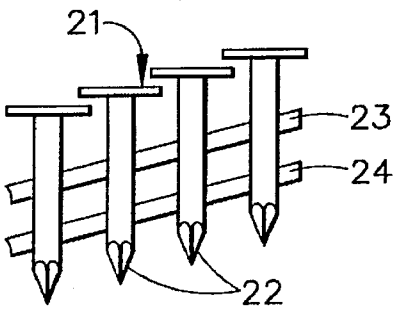
FIG. 2 is a fragmentary elevational view of an exemplary strip of nails.

FIG. 2 is a fragmentary elevational view of an exemplary strip 21 of headed nails 22. The nails are arranged in a tandem row and joined together to form the strip by joining means of such nature that the strip can be coiled. In the exemplary embodiment illustrated in FIG. 2, a pair of frangible wires 23 and 24 are welded to the shank of each nail 22 to form the strip 21. As indicated above, there are other nail joining means for maintaining a series of nails in a coilable strip including tape means, paper means, plastic means and the like, all of which have long been known in the art.

It is frequently desirable to provide a nail driving tool 1 and a magazine 2 capable of accommodating coils of nails of different shank lengths. This is accomplished with respect to the magazine by providing the magazine with a fastener coil supporting platform which is adjustable in position between the top 19 and the bottom 12 of magazine 2.

Figure 4:
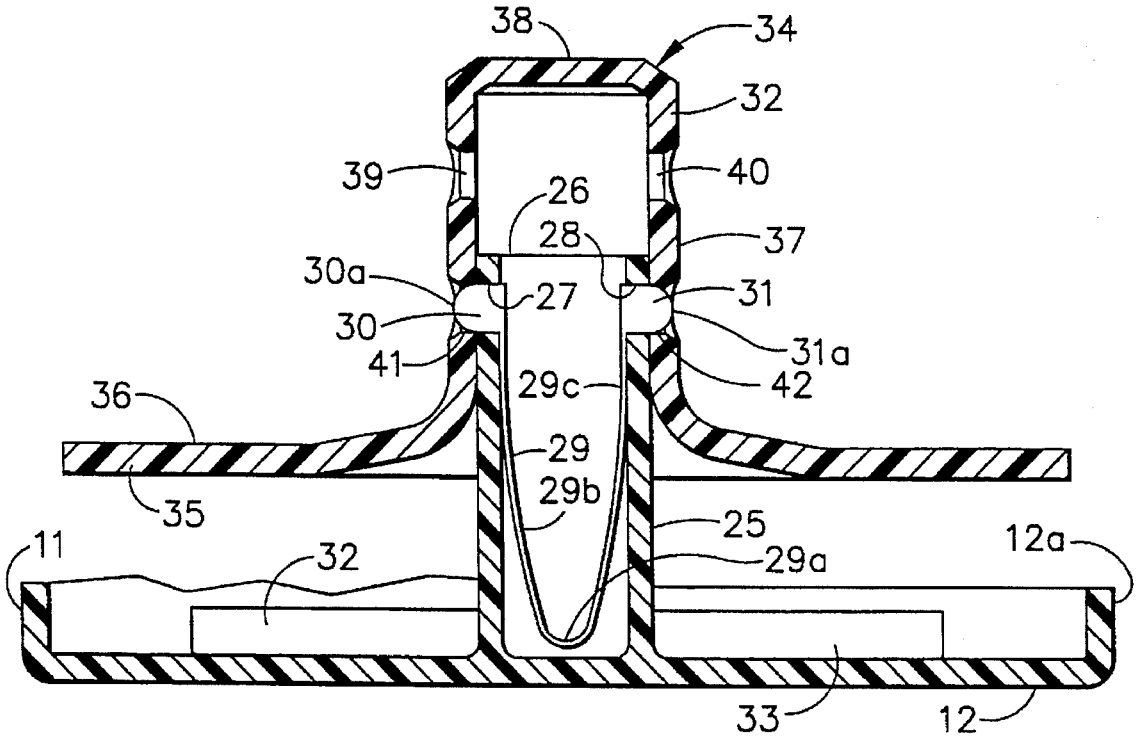
FIG. 4 is a cross-sectional view taken along section line 4—4 of FIG. 3 illustrating the fastener coil supporting platform in its upper position.
Figure 5:
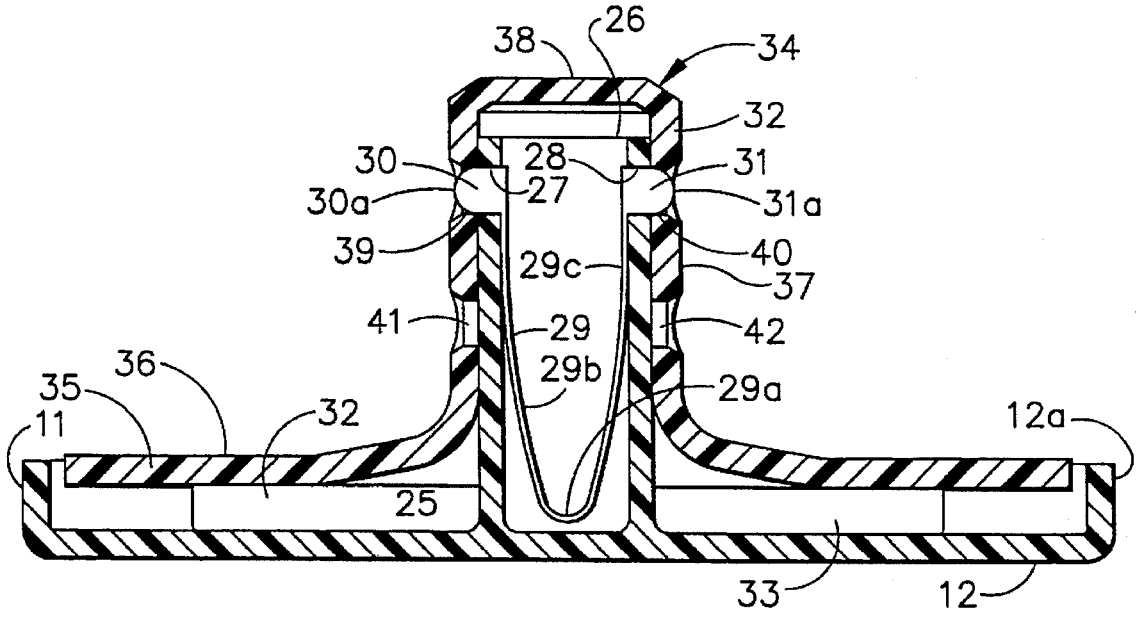
FIG. 5 is a cross-sectional view, similar to FIG. 4, and illustrating the fastener coil supporting platform in its lower position.

Reference is made to FIGS. 3, 4 and 5. As is most clearly shown in FIG. 3, that peripheral portion of magazine bottom 12 which is not integral with fixed side wall portion 11 is provided with an upstanding flange 12*a*. Centrally of magazine bottom 12 there is located an upstanding, hollow, open top magazine post 25. While not required, magazine post 25 is preferably a cylindrical member having a circular transverse cross-section. Near the upper end 26 of magazine post 25 there is a pair of diametric openings 27 and 28 extending through the cylindrical side wall of post 25. Located within the hollow magazine post 25 there is a U-shaped spring latch member 29 having a base portion 29*a* and upstanding legs 29*b* and 29*c*. The latch member legs 29*b* and 29*c* terminate in laterally extending latch elements 30 and 31 provided with rounded outer ends 39*a* and 31*a*, respectively.

The spring latch member 29 is assembled in magazine post 25 by squeezing the latch elements 30 and 31 toward each other and shoving the spring member into the hollow magazine post 25. When the latch elements 30 and 31 are properly aligned with magazine post openings 27 and 28, they will snap into these openings and achieve their normal-positions as shown in FIGS. 4 and 5. Thus, even when the latch elements are in their normal positions, the spring latch member 29 is slightly compressed so that the latch elements 30 and 31 are constantly urged toward their normal positions and are thus captive within the magazine post 25. It will be noted from FIGS. 4 and 5 that when the latch elements 30 and 31 are in their normal positions, their rounded ends 39*a* and 31*a* extend beyond the peripheral surface of magazine post 25. It will be further noted from FIGS. 4 and 5 that the inside surface of canister bottom 12 may be provided with integral reinforcing ribs extending radially from magazine post 25. Two such ribs are shown at 32 and 33.

To complete the magazine structure, a fastener coil supporting platform is provided and is generally indicated at 34. The fastener coil supporting platform 34 comprises a circular portion 35 providing a planar upper surface 36 which constitutes the support surface for the fastener coil. The circular portion 35 has an outside diameter of such dimension as to fit within the magazine wall portions 11 and 18 with clearance. At its center, the circular portion 35 tapers upwardly into a hollow support post 37 having an open bottom end and a closed top 38. The hollow coil supporting platform post may have any transverse cross sectional configuration so long as it matches that of the magazine post. As indicated above, a circular cross section is preferred. In the Figures the coil supporting post has an internal diameter approximating the external diameter of magazine post 25 and capable of receiving magazine post 25 with a close sliding fit.

It will be noted that the coil supporting platform post 37 is provided with an upper pair of diametric openings 39 and 40 and a lower pair of diametric openings 41 and 42. When the coil supporting platform 34 is placed over magazine post 25 the curved open bottom portion of the support post will cooperate with the rounded noses 39*a* and 31*a* of latch elements 30 and 31 causing these latch elements to shift to a retracted position wherein their rounded nose portions 39*a* and 31*a* do not extend beyond the periphery of magazine post 25. When the diametric openings 41 and 42 are aligned with latch elements 30 and 31. The latch elements 30 and 31 will snap into the platform post openings 41 and 42, locking the supporting platform in a first extended position with respect to the magazine post 25, as shown in FIG. 4.

By virtue of the fact that the openings 41 and 42 are countersunk, the operator may use his fingers to depress the latch elements 30 and 31 to their retracted position and the coil supporting platform 34 may either be removed from magazine post 25 or shoved further down on magazine post 25 until the latch elements align with and snap into the second pair of diametric openings 39 and 40 of the support platform. This latter instance is illustrated in FIG. 5 wherein the coil supporting platform 34 is shown in its retracted position with respect to magazine post 25.

It will be understood by one skilled in the art that the extended position of the coil supporting platform 34 will accommodate a coil of shorter mils, while the retracted position of coil supporting platform 34 in FIG. 5 will accommodate a coil of longer nails. Thus, the exemplary embodiment illustrated in FIGS. 3–5 can accommodate coils of two different size mils. It will be understood by one skilled in the art that additional diametric openings could be provided in the coil supporting platform post so that the coil supporting platform 34 might have more than two locked positions on and with respect to magazine post 25.

It will be evident from the description above that the adjustment of the coil supporting platform 34 on post 25 is a simple, easy, manual operation which does not require disassembly of any part of the magazine 2 and which can be accomplished rapidly and efficiently. The latch member 29 is very simple in construction and, while it is easily removable and insertable into magazine post 25, it is normally captively held therein. The magazine fixed and hinged parts, as well as the coil supporting platform 34, lend themselves well to be molded of appropriate plastic material such as nylon.

Modifications may be made in the invention without departing from the spirit of it. For example, it would be within the scope of the invention to provide the magazine post with just one of holes 41 and 42 and latch member 29 with just one of latch elements 30 and 31. Under these circumstances, the support post 37 could be provided with just one of openings 39 and 40, and just one of openings 41 and 42.

What is claimed:

1. A canister-type magazine for a fastener driving tool using a coil of tandemly arranged fasteners, said magazine comprising a substantially cylindrical body having a top, a bottom, side walls and being made up of a fixed body part and a movable body part, said fixed body part having forward and rearward ends attached to said tool body, said fixed body part comprising a first side wall and said bottom of said magazine, said movable body part having forward and rearward ends and comprising a top portion and a second side wall of said magazine, said movable body part being operatively attached to said fixed body part near said rearward ends of said fixed and movable body parts, said movable body part being pivotable with respect to said fixed body part between a closed position wherein said bottom is not accessible and an open position wherein said bottom is accessible, a magazine post having a top surface and a peripheral surface extending perpendicularly with respect to said bottom and centrally thereof, a locking means including at least one latch element being located in at least one opening in said magazine post, said at least one latch element being shiftable between a locking position wherein a portion of said at least one latch element extends beyond the peripheral surface of said magazine post and an unlocking position wherein said portion is within the confines of the peripheral surface of said magazine post, said at least one latch element being biased to said locking position, a fastener coil supporting platform locatable within said magazine, said supporting platform having a hollow center post with a side wall extending perpendicularly with respect to said supporting platform, said platform post being adapted to telescopically receive said magazine post, said platform post side wall having at least two openings formed therethrough at positions differing in distance from said support platform, each of said at least two platform post openings being alignable coaxially with said at least one magazine post opening to receive said at least one latch element, whereby said platform is lockable at each of said positions on said magazine post to accommodate coils of fasteners of different lengths, wherein said locking means, in said unlocking position, is nested completely within said peripheral surface and below said top surface of said magazine post.

2. The canister-type magazine claimed in claim 1 including a pair of latch elements located in diametric openings in said magazine post side wall, said pair of latch elements being shiftable between said locking position wherein both latch elements extend beyond the peripheral surface of said magazine post side wall and said unlocking position wherein both of said latch elements are located within the confines of said peripheral surface of said magazine post side wall, said platform post side wall having at least two sets of diametric openings formed therethrough at positions differing in distance from said support platform, each of said at least two pairs of platform post openings being alignable coaxially with said magazine post openings to receive said latch elements, whereby said platform is lockable at each of said positions on said magazine posts to accommodate coils of fasteners of different lengths.

3. The canister-type magazine claimed in claim 2 wherein said magazine post comprises a hollow open top post having a cylindrical side wall with said peripheral surface, said platform post being cylindrical, a latch member, said latch member comprising a U-shaped spring having a base portion and upstanding divergent legs terminating in free ends, said latch elements each extending laterally from one of said free ends of latch member legs, said latch member legs with said latch elements thereon being shiftable toward each other and said latch member being insertable in said hollow cylindrical open top magazine post with clearance for said latch elements, when coaxial with said magazine post diametric openings, said latch elements being shiftable to and biased to said locking position by said legs of said latch member, said latch elements being shiftable to said unlocking position against the action of said latch member legs.

4. The canister-type magazine claimed in claim 3 wherein said fasteners are nails.

5. The canister-type magazine claimed in claim 1 wherein said fasteners are nails.

6. The canister-type magazine claimed in claim 1 wherein said magazine post and said platform post are cylindrical.

* * * * *